US005621939A

United States Patent [19]

Yoshida et al.

[11] Patent Number: 5,621,939

[45] Date of Patent: Apr. 22, 1997

[54] APPARATUS FOR REGENERATING RECORDING MEDIUM

[75] Inventors: Masazumi Yoshida, Amagasaki; Susumu Tanaka, Aichi-ken; Junji Machida; Kaoru Furusawa, both of Toyonaka, all of Japan

[73] Assignee: Minolta Co., Ltd., Osaka, Japan

[21] Appl. No.: 177,001

[22] Filed: Jan. 3, 1994

[30] Foreign Application Priority Data

| | | | |
|---|---|---|---|
| Jan. 8, 1993 | [JP] | Japan | 5-001657 |
| Jan. 12, 1993 | [JP] | Japan | 5-003224 |
| Oct. 29, 1993 | [JP] | Japan | 5-271665 |
| Nov. 2, 1993 | [JP] | Japan | 5-274385 |

[51] Int. Cl.[6] ..... G03D 3/08

[52] U.S. Cl. ..... 15/77; 15/100; 15/102; 15/308; 134/122 R; 396/617; 396/622

[58] Field of Search ..... 15/77, 88.3, 102, 15/100, 308, 309.2; 354/317, 320–322; 134/122 R, 9

[56] References Cited

U.S. PATENT DOCUMENTS

| | | | |
|---|---|---|---|
| 2,781,535 | 2/1957 | Phillips et al. | 15/77 |
| 3,333,291 | 8/1967 | Hondzinski | 15/77 |
| 3,562,834 | 2/1971 | Stievenart et al. | 15/77 |
| 3,694,071 | 9/1972 | Touchette | 15/77 |
| 3,792,503 | 2/1974 | Brock | 15/77 |
| 3,938,213 | 2/1976 | DiFede | 15/77 |
| 4,148,576 | 4/1979 | Martino | 15/77 |
| 4,383,751 | 5/1983 | Schornig | 15/77 |
| 4,428,659 | 1/1984 | Howard | 15/77 |
| 4,464,035 | 8/1984 | Schoering | 15/77 |
| 4,475,259 | 10/1984 | Ishii | 15/77 |
| 4,733,422 | 3/1988 | Schramm et al. | 15/77 |
| 4,942,421 | 7/1990 | Gumbinner | 15/77 |
| 5,059,996 | 10/1991 | Bailey et al. | 15/77 |
| 5,089,839 | 2/1992 | Nakano et al. | 15/77 |
| 5,205,303 | 4/1993 | Gileta | 134/122 R |

FOREIGN PATENT DOCUMENTS

| | | | |
|---|---|---|---|
| 509785 | 10/1930 | Germany | 15/77 |
| 4-89271 | 3/1992 | Japan . | |
| 4-91298 | 3/1993 | Japan . | |

*Primary Examiner*—David Scherbel
*Assistant Examiner*—Randall E. Chin
*Attorney, Agent, or Firm*—Sidley & Austin

[57] ABSTRACT

An apparatus for regenerating a recording medium has a feeder which feeds a recording medium, a transporter which transports the recording medium, an immersion bath for containing a cleaning liquid for swelling prints and immersing the recording medium in the cleaning liquid, a print remover which removes the prints by subjecting the surface of the recording medium to a physical treatment, and a fluidizing structure for fluidizing the cleaning liquid in a direction opposite to a direction in which the recording medium is transported in the immersion bath.

6 Claims, 15 Drawing Sheets

APPARATUS FOR REGENERATING RECORDING MEDIUM

BACKGROUND OF THE INVENTION

1. Field of the Invention

The present invention relates to an apparatus for regenerating a recording medium by removing printed portions of a recording medium produced by such printing devices as electrophotography, printers, and facsimiles.

2. Description of the Prior Art

From a natural resource preservation point of view, the recycling technique has been drawing increasing attention as an earth-friendly technique. As copying machines have so far spread into every field of activities such as companies and offices, used paper out of their copied paper is also under research for its recycling technique, backed by a desire for effective utilization of the resources.

Copied paper in many cases must be kept in secret, so that copied paper is once cut into small pieces and then regenerated into pulp. However, this method would result in so short pulp fibers that the regenerated paper obtained is quite easy to break. Further, the regenerating equipment involved is so complex and large that regeneration of used paper often could not be achieved without relying on particular expert dealers.

As a regeneration technique to solve such problems, a print removing apparatus is disclosed in Japanese Patent Laid-Open Publication No. HEI 4-89271 in which printed portions are removed without cutting the paper into small pieces. This apparatus removes printed portions through steps of applying a cleaning liquid onto the surface of used paper by rollers and then subjecting the paper surface to physical treatment.

However, the above-mentioned apparatus would cause separated toner to float in the cleaning liquid and be readsorbed to the used paper, adversely resulting in insufficiency in print removal.

SUMMARY OF THE INVENTION

Accordingly, the object of the present invention is to provide an apparatus for regenerating a recording medium which can regenerate a recording medium simply and securely without cutting the medium into .small pieces.

According to the present invention, the apparatus for regenerating a recording medium comprises: a feed means for feeding a recording medium; a transport means for transporting the recording medium; an immersion bath for containing a cleaning liquid for swelling prints and immersing the recording medium in the cleaning liquid; a print removing means for removing the prints by subjecting the surface of the recording medium to a physical treatment; and a fluidizing means for fluidizing the cleaning liquid in a direction opposite to a direction in which the recording medium is transported in the immersion bath.

DETAILED DESCRIPTION OF THE INVENTION

The present invention relates to an apparatus for regenerating a recording medium comprising: a feed means for feeding a recording medium; a transport means for transporting the recording medium; an immersion bath for containing a cleaning liquid for swelling prints and immersing the recording medium in the cleaning liquid; a print removing means for removing the prints by subjecting the surface of the recording medium to a physical treatment; and a fluidizing means for fluidizing the cleaning liquid against a direction in which the recording medium is transported in the immersion bath.

The apparatus for regenerating a recording medium of the present invention is so designed to scrape off with a brush or the like printed portions that have floated from the recording medium by previously immersing the recording medium in the cleaning liquid, thus capable of removing printed portions completely without damaging the surface of the recording medium. Further, the apparatus is also designed to remove printed portions in the flow of the cleaning liquid, so that a fresh cleaning liquid is normally fed to the surface of the recording medium. As a result, the apparatus for regenerating a recording medium provides recycled paper of such high whiteness as to be successfully reused.

Examples of the present invention are now described with reference to the accompanying drawings.

EXAMPLE 1

Figure 1:
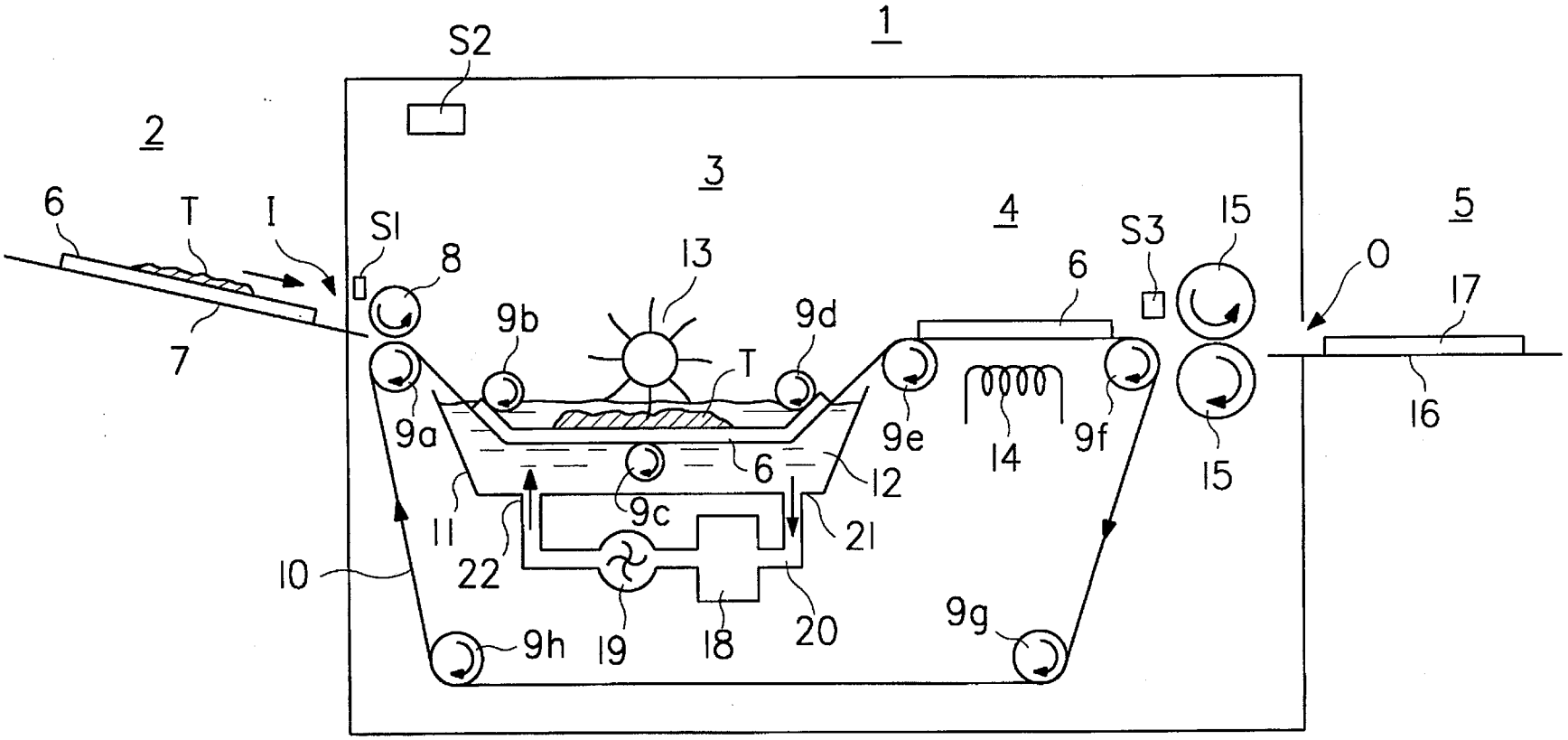
FIG. 1 is a view showing a schematic construction of an apparatus for regenerating a recording medium according to Example 1 of the present invention.

FIG. 1 shows a general construction of an apparatus for regenerating a recording medium according to the present example.

In FIG. 1 there is shown a recording medium 6, which is a sheet of paper or a so-called OHP (Over Head Projector) sheet such as a polyester film on which a toner image T containing at least a resin component is recorded. Such recording media having toner images are produced by conventionally known so-called OA (Office Automation) equipments, such as a copying machine, printers, or facsimiles.

A paper feeder 2 included in a main body of a regenerating apparatus 1 comprises an opening I through which the recording medium 6 is introduced, and a paper feed tray 7 given a tilt so as to feed the recording medium 6 to the opening I. Although the paper feed tray 7 is designed for the operator to manually feed the recording medium 6 in this example, it may instead be an automatic paper feeder which is known and used for the manual feed tray of copying machines or the like.

At least either one of a paper feed roller 8 and a transport roller **9*a* is provided by a roller made of an elastic material, for example, urethane with its surface rough-finished. In this example, the paper feed roller 8 is urged against the transport roller 9*a* at a constant pressure with a later-described transport belt 10 pinched therebetween. One end of the recording medium 6 fed from the paper feed tray 7 is pinched between the rollers 8 and 9*a*, where the recording medium 6** stops.

A sensor S1 issues a start signal when one end of the recording medium 6 enters the apparatus 1 through the opening I. Then based on this start signal, the transport rollers **9*a*–9*h* are driven to rotate. The arrangement that such a signal from the sensor S1 is used to automatically drive the transport rollers 9*a*–9*h*** into rotation, as shown above, is one thing, and another may be adopted. The start signal will be issued only when an input by the operator is sensed by a switch S2 which is additionally provided.

On the output of the start signal, the transport rollers **9*a*–9*h*, having the transport belt 10 stretched over, are driven to rotate at a specified speed in the direction indicated by arrow in the figure by a drive means (motor or the like), which is not shown. Then, the recording medium 6, one end of which has been pinched between the rollers 8 and 9*a*, is transported through a cleaning unit 3 and a drier unit 4 up to calender rolls 15. It is noted that the transport rollers 9*a* to 9*h* may be arranged to be driven into rotation for a predetermined time period under control of a timer, or to continue to be driven until the recording medium 6 is sensed to have reached the calender rolls 15** by a sensor S3, which is additionally provided.

The transport belt 10 is provided in such a form as a thin film, an elastic material, an unwoven cloth, or a fiber-woven cloth. Preferably, the transport belt 10 is roughened or meshed on its surface. In this case its performance of the transportation of the recording medium 6 is improved. The material for the transport belt 10 may be a metal, a polymer or the like, and is not limitative, but should be selected from those which will not be easily corroded by the cleaning liquid. Plate-shaped ones made of steel are suitably employed.

The cleaning unit 3 comprises: an immersion bath 11 filled with a cleaning liquid 12; a feed roller **9*c* fully immersed in the cleaning liquid 12; feed rollers 9*b* and 9*d* nearly half immersed in the cleaning liquid 12; the transport belt 10 stretched between the feed roller 9*c* and the rollers 9*b*, 9*d*; a circulation path 20 for connecting an inlet 21 and an outlet 22, two openings provided at the bottom of the immersion bath 11, with each other; a filter 18 provided within the circulation path 20; a pump 19; and a print removing means 13 for scraping off toner that has swollen with the cleaning liquid 12 by applying a physical force to the toner image T on the recording medium 6 immersed in the cleaning liquid 12**.

In this case, the distance between the roller **9*b* and the roller 9*d* is desirably shorter than the length of the recording medium 6. The reason is that if the roller-to-roller distance is longer than the length of the recording medium 6, the recording medium 6 may float up within the immersion bath 11 such that it could not be physically treated enough by the print removing means 13. However, since the recording medium 6 will be swollen by the cleaning liquid 12, it is not necessarily essential that the distance between the feed rollers 9*b* and 9*d* is arranged shorter than the length of the recording medium 6 to prevent the recording medium 6** from floating up.

The print removing means 13 may be in the form of a rotary brush, for example, as shown in FIG. 1. The material for such a brush is preferably polymer fibers exemplified by nylon, acryl, and polyester so that the surface of the recording medium 6 is kept free from damage. Additionally, although not shown, there may be provided a means for recovering swollen toner collected from the recording medium 6 and other dirties from the print removing means 13.

Figure 2:
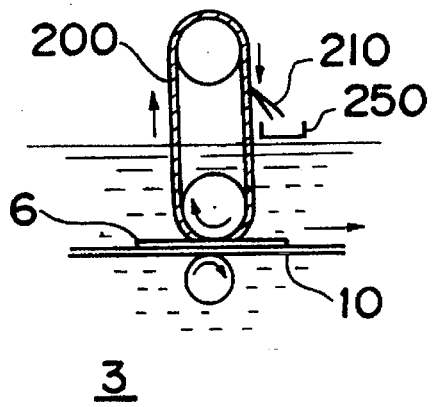
FIG. 2 is a view showing an aspect of the print removing means (web)
Figure 3:
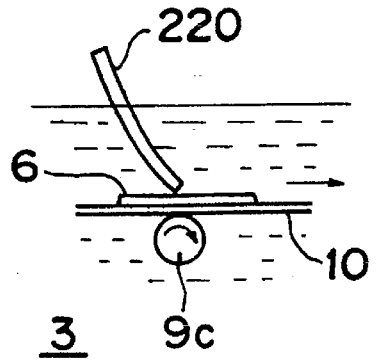
FIG. 3 is a view showing an aspect of the print removing means (blade)
Figure 4:
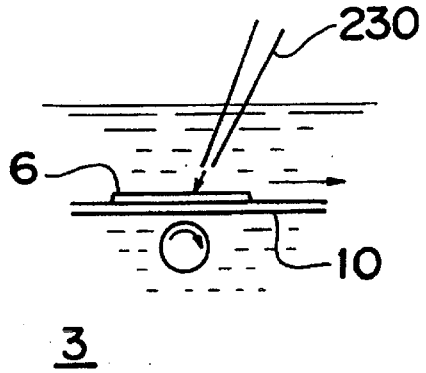
FIG. 4 is a view showing an aspect of the print removing means (nozzle)

The form of the print removing means 13 is not limited to the rotary brush, but may also be a cloth belt (web) 200 stretched between the drive rollers as shown in FIG. 2, a blade 220 urged against the roller **9*c* as in FIG. 3, or a nozzle 230 through which the cleaning liquid is blown off at high pressure as in FIG. 4, for example. The web 200 may be provided preferably by a fiber-woven cloth or a rough-surfaced metal belt, or the like with a view of enhancing the scraping effect of its surface. The means for recovering swollen toner and other dirties from the surface of the web 200 may be so arranged that a blade 210 is pushed into contact with the web 200 to scrape the toner and dirties down into a recovery box 250 as shown in the figure. The blade 220 is preferably made of an elastic material such as metal or rubber, and combined with an unshown urging means (e.g. a spring) to scrape off the toner from the surface of the recording medium 6**.

In addition, the print removing means 13 may be so arranged as to move in the immersion bath 11 in the direction in which the transport belt 10 is transported or in a direction perpendicular to the direction so that its cleaning effect is enhanced.

The circulation path 20 is provided with a pump 19 to take in the cleaning liquid 12 out of the immersion bath 11 through the inlet 21 and discharge it though the outlet 22. Further, the filter 18 is provided above the pump 19 with respect to the direction of circulation of the cleaning liquid 12, to collect the swollen toner and other dirties floating within the immersion bath 11. Accordingly, the cleaning liquid in the immersion bath 11 is normally kept at a constant degree of cleanness. The filter 18 is arranged to be replaceable if desired, and may be made of glass wool, activated carbon, or the like.

Within the immersion bath 11, there may be provided an ultrasonic vibration means or a heater for enhancing the cleaning effect. Particularly when a heater is provided, the cleaning liquid would differ in its cleaning effect depending on the type of the cleaning liquid itself and environmental temperature, showing greater effect. Although depending on the type of the cleaning liquid, the temperature is preferably maintained at 30°–50° C.

A drier unit 4 is provided below the immersion bath 11 with respect to the direction in which the transport belt 10 moves. The drier unit 4 comprises a flat surface formed between feed rollers 9*e* and 9*f*, and a heater 14 for heating the flat surface. The flat surface preferably has a length longer than that of the recording medium 6 to be treated. The reason is that whereas the cleaning liquid will volatilize when heated by the heater 14, the recording medium 6, if dried on a non-flat surface, would be likely to result in non flatness, such that the treated recording medium 6 might be deteriorated in value. However, this arrangement is not necessarily indispensable because such resultant non-flat recording medium is subjected to a flattening treatment by the calender rolls 15, which will be described later.

The heater 14 is not limited to the form of heating by heat transport, but may be also the one using hot air or radiant heat of a xenon lamp or the like. The heating temperature is preferably optimized depending on the cleaning liquid 12 used and the type of the recording medium 6, and generally set at 40°–90° C., preferably 50°–60° C. Lower temperatures would result in a longer drying time. This is disadvantageous to practical use. Higher temperatures would cause deformation of the recording medium 6 in the case of OHP sheets, or yellowish change in the case of paper, disadvantageously.

The recording medium 6 that has undergone the drier unit 4 is transported to the calender rolls 15. The calender rolls 15 are a pair of metallic rolls urged into contact with each other. Making the dried recording medium 6 pass between the rolls allows the recording medium 6 to be recovered out of minute damage on its surface, traces of bending, and the like given through the cleaning unit 3, and further to be polished in the case of paper recording medium 6. Also, the recording medium 6 with minute defects due to a stapler and the like can be recovered to some degree.

It is noted that the calender rolls 15 may include a heater to also serve drying function. Such an arrangement allows the drier unit 4 to be omitted.

The recording medium 6 passed through the calender rolls 15 is discharged through a discharge outlet O onto a paper discharge tray 16 as regenerated paper 17.

Although differing in extent depending on the processing in the cleaning unit 3, the type of the cleaning agent 12, and the like, the recording medium 6 can be regenerated to such an extent that the regenerated paper 17 has the toner image T completely removed from the surface enough to be used newly as a recording medium. A great merit can be offered especially when expensive OHP sheets are used. Otherwise, the recording medium 6 can be treated to at least such an extent that at least the toner image T thereon is made unreadable, which serves for secrecy retention of the recording medium in place of using a shredder.

Operation

The operation of Example 1 is described below.

Based on the start signal from the sensor S1, the transport rollers 9*a*–9*h* are driven for a specified time period, temporarily stopping when the recording medium 6 has been fully immersed in the immersion bath 11. During this operation, the print removing means 13 is independently controlled in operation by a control means (not shown) so as not to be driven. It is to previously swell the toner image T before scraping it off by the print removing means 13 for enhanced effect of print removal that the recording medium 6 is stopped within the immersion bath 11. Of course, instead, the print removing means 13 may be driven while the recording medium 6 is being transported at a specified speed without being stopped. Otherwise, the operation may be controlled in such a way that the recording medium 6 is transported at lower speed only in the immersion bath 11 than in any other transport portion, so that the cleaning efficiency and the total processing speed are well balanced. The swelling time for which the recording medium 6 is temporarily stopped as fully immersed in the immersion bath 11 should be determined from the balance between the cleaning efficiency and the total processing speed, and is preferably a few seconds to ten-odd minutes in practical case.

After swelling, the print removing means 13 is started to be driven while the feed rollers 9 are started to be driven simultaneously. The recording medium 6 is subjected to physical treatment for cleaning. With the treatment over, the recording medium 6 is transported to the flat portion of the drier unit 4.

The recording medium 6 transported to the flat portion is again temporarily stopped, with a sufficient drying time ensured.

After the drying, the feed rollers 9 are driven once again so that the recording medium 6 is transported until its end is pinched between the calender rolls 15. When the sensor S3 senses this state, the calender rolls 15 are driven so that the recording medium 6 is subjected to regeneration treatment of defects on its surface and then discharged onto the discharge tray 16.

EXAMPLE 2

Figure 5:
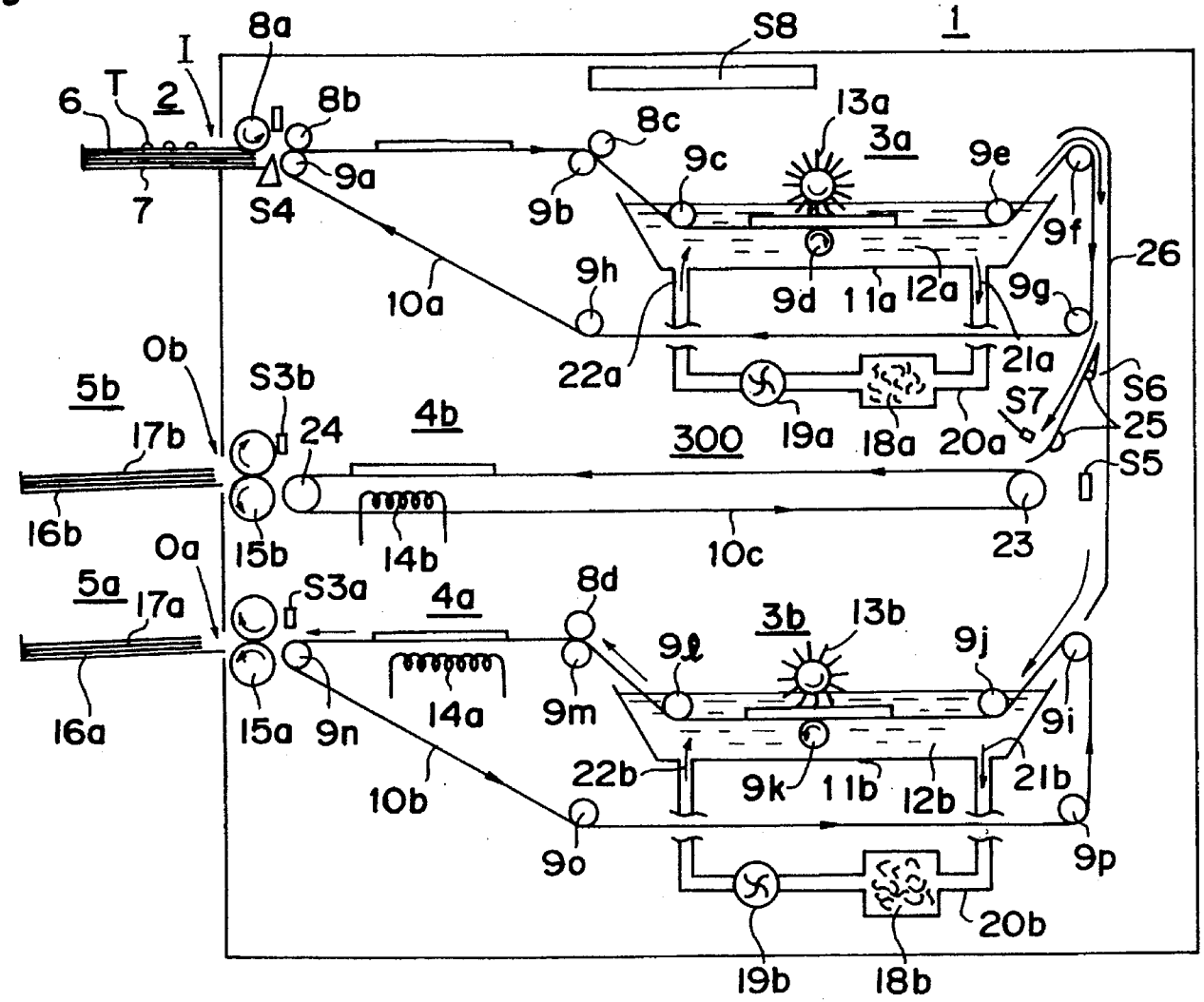
FIG. 5 is a view showing a schematic construction of an apparatus for regenerating a recording medium according to Example 2 of the present invention.

FIG. 5 shows a schematic construction of an apparatus for regenerating a recording medium. This apparatus is a modification of the apparatus of Example 1, modified in such a way that the cleaning unit can treat both copy paper printed on its both surfaces and copy paper printed on its one surface.

The apparatus of this example has two cleaning units 3*a*, 3*b*, a guide plate 26 for reversing a recording medium; a branch switch S6, and a unit 300 having a transport belt 10*c* and a drier unit 4*b* for drying and discharging paper after subjecting it to only one-surface treatment in the case of one-surface printing, the apparatus further comprising a sensor S4 for detecting whether or not the paper is printed on its both surfaces.

Operation

The operation of Example 2 is described below.

The sensor S4 is installed so as to pinch the both surfaces of the recording medium 6. When the recording medium 6 passes through the sensor S4, the sensor S4 determines whether the recording medium 6 is printed on its both surfaces or on only its one surface. Naturally, the operator may designate one-surface or both-surface treatment with an input through a switch S8, when it is previously known whether the recording medium is printed on only its one surface or on its both surfaces.

When the recording medium 6 has been determined to have toner T printed on its both surfaces, the branch switch S6 is tilted down on the left side in the figure about a fulcrum 25. The recording medium 6 is transported to the cleaning unit 3*a*, where it is cleaned on its one surface in the same way as in Example 1. Thereafter, the recording medium 6 is transported downward along the guide plate 26 by a transport belt 10*a* to the cleaning unit 3*b*. The timing of driving the cleaning unit 3*b* may be determined either by a sensor S5 as shown in FIG. 5 or by a timer that controls a predetermined time elapse from when the cleaning unit 3*a* began to be driven. Toner T on its opposite surface is cleaned by the cleaning unit 3*b* and, after passing through a drier unit 4*a* and calender rolls 15*a*, the recording medium is discharged from a discharge outlet Oa onto a discharge tray 16*a* as regenerated paper 17*a*.

When the recording medium 6 has been determined to have toner T printed on only its one surface by the sensor S4, the branch switch S6 is tilted down to the right side. The recording medium 6 cleaned by the cleaning unit 3*a* is led to the unit 300 by the branch switch S6. A sensor S7 senses the paper, making the unit 300 driven. It is arranged that the cleaning unit 3*b* will not operate when the unit 300 is driven. The recording medium 6, after passing through the drier unit 4*b* and calender rolls 15*b*, is discharged through a discharge outlet Ob onto a discharge tray 16*b* as regenerated paper 17*b*.

According to this example, the apparatus is capable of regenerating a recording medium having copied prints on its one surface or both surfaces. Of course, the apparatus of this example may also be arranged so that the unit 300 and the branch switch S6 are omitted and any paper is forcedly subjected to cleaning treatment on its both surfaces.

EXAMPLE 3

Figure 6:
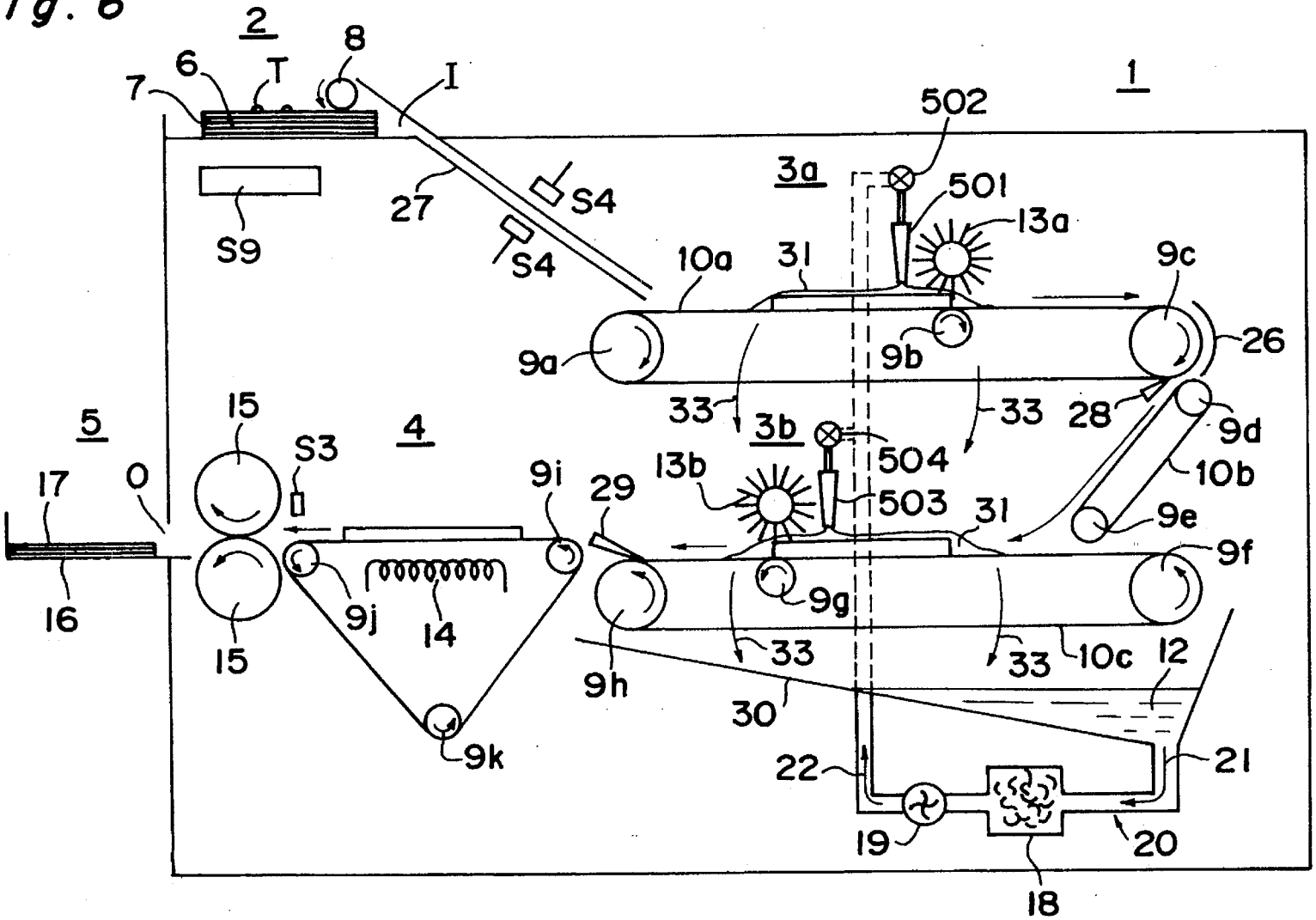
FIG. 6 is a view showing a schematic construction of an apparatus for regenerating a recording medium according to Example 3 of the present invention.

FIG. 6 is a view showing a schematic construction of an apparatus for regenerating a recording medium of Example 3. This example provides an apparatus for regenerating a recording medium in which immersion of a recording medium into the cleaning liquid is implemented by discharging the cleaning liquid from nozzles 501, 503 instead of using the immersion bath 11 of the foregoing example. The apparatus also has two cleaning units 3*a*, 3*b*, thus capable of treating recording media either printed on its both surfaces or on its one surface.

Operation

The operation of Example 3 is described below.

A recording medium 6 transported to the cleaning units 3*a*, 3*b* is temporarily stopped at the position or transported enough slowly. The cleaning liquid is discharged onto the recording medium 6 through the nozzles 501, 503, thereby making toner T enough swollen. In this process, the flow rate of the cleaning liquid is previously controlled by control valves 502, 504 so as to be discharged in such an amount that the cleaning liquid keeps fully covering the surface of the recording medium 6 while washing away it, i.e., that the recording medium 6 is held sufficiently immersed in the cleaning liquid.

Next, the recording medium 6 is cleaned by a print removing means similar to that of Example 1, with the toner released into the flowing cleaning liquid. The cleaning liquid containing the cleaned-off toner T overflows both sides of the belt so as to be collected into a liquid reservoir 30 having a substantially large opening under the belt. As a result, floating toner will not readhere to the recording medium. The cleaning liquid collected into the liquid reservoir 30 passes through the filter 18, then through the outlet 22 by action of the pump 19, and again sprayed from the nozzles.

As in the case of Example 2, a sensor S4 is used to detect whether or not the recording medium is printed on its both surfaces. When it is printed on both surfaces, the recording medium is cleaned by both cleaning units 3*a*, 3*b*. When it is printed on one surface, on the other hand, the control valve 504 is closed so that the cleaning liquid is stopped being discharged from the nozzle 503. Thereafter, the recording medium, passing through the drier unit 4 and the calender rolls 15, is discharged through the discharge outlet 0.

EXAMPLE 4

Figure 7:
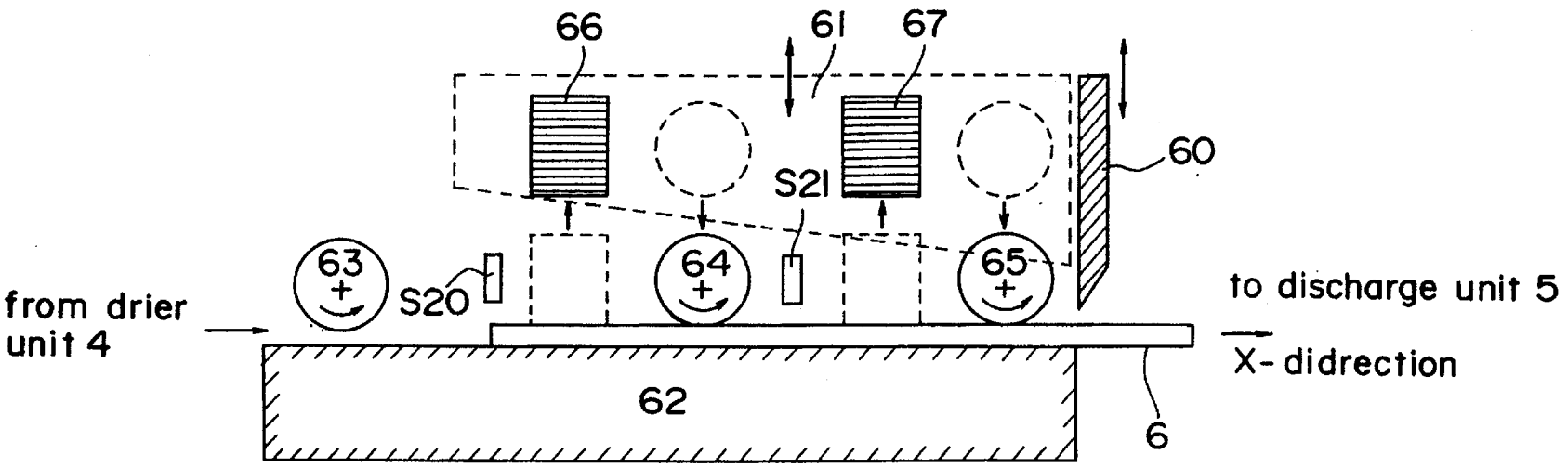
FIG. 7 is a view showing an exemplary construction of the cutter system of an apparatus for regenerating a recording medium according to Example 4 of the present invention.

The apparatus of this example has the same construction as in Example 1 except that between the drier unit 4 and the discharge unit 5 there is provided a cutter unit capable of cutting paper at any arbitrary widths in its longitudinal and lateral directions. Therefore, description of the construction other than the cutter unit is omitted. FIG. 7 shows a schematic construction of the cutter unit.

A recording medium 6 that has passed through the calender rolls 15 in FIG. 1 is transported onto a cutter base seat 62. According to a signal from an x-direction paper end sensor S20, x-direction paper feed rollers 63–65 convey the recording medium to a specified position, where a portion of the paper including a defect is cut off by an x-direction blade 60. Next, according to a signal from a y-direction paper end sensor S21, x-direction paper feed rollers 66–67 convey the recording medium 6 to a specified position, where a portion of the recording medium including a defect is cut off by a y-direction blade 61. It is noted that the order in which the recording medium 6 is cut in the x- and y-direction is of no much significance. Besides, the cutter is not limited to a blade, but may also be a wire cutter or another of various types.

Pieces of the cut paper are collected in a shred collection box. These pieces of paper are sent to an expert paper-recycling plant in a lump, where they are formed into pulp for reuse. Thus, the recording medium can be all put into effective use without being wasted. Those pieces of paper have been cleaned enough to be successful in terms of secrecy retention.

The recording medium 6 that has passed through the cutter unit is discharged as the regenerated paper 17 onto the discharge tray 16 through the discharge outlet O by a discharge roller.

Although differing in extent depending on the processing time by the cleaning unit 3, the type of the cleaning liquid 12, and the like, the recording medium 6 can be regenerated to such an extent that it can be used as a new recording medium with the toner image T completely removed from the regenerated paper 17. This offers a great merit especially when expensive OHP sheets are used. Otherwise, the recording medium 6 can be treated to at least such an extent that the toner image T thereon is made unreadable, which serves for secrecy retention of the recording medium in place of using a shredder.

Operation

The operation of the cutter unit is described below.

The recording medium that has been discharged to the cutter unit is adjusted for positioning by the sensors S20, S21. For example, in the case of operation in which A4 size paper is to be regenerated into B5 size paper, the sensor S20 is set to 182 mm from the edge of the cutter base seat 62 while the sensor S21 is set to 257 mm from the cutter base seat 62. These sensors S20, S21 may be set for the regeneration size previously by a switch S2 provided in proximity to the paper inlet in accordance with an instruction, or also may be set by a signal that is produced as a result of sensing front and rear ends of the paper by a sensor S1 and calculating the paper's length according to the time difference between the two ends.

The recording medium that has been transported to the cutting unit is further transported in the x-direction by the paper feed rollers 63–65. At a time point when the paper rear end is sensed by the sensor S20 (x-direction), the paper feed rollers 63–65 are stopped. Then the recording medium is cut off by the blade 60 (x-direction). In this process, the paper feed rollers 66 (y-direction) and 67 are kept retreated upward.

Next, the paper feed rollers 63–65 are retreated upward and, in turn, the paper feed rollers 66–67 (y-direction) are lowered. At a time point when the paper rear end is sensed by the sensor S21 (y-direction), the paper feed rollers 66–67 are stopped. Then the recording medium is cut off by the blade 61 (y-direction).

The paper feed rollers 66–67 are again retreated upward and, in turn, the paper feed rollers 63–65 are lowered. The recording medium that has been completely reshaped is discharged onto the discharge tray 16 through the discharge outlet O by a discharge roller.

It is noted that the order in which the recording medium is cut off in x- and y-direction is not particularly limited to the above-mentioned one.

EXAMPLE 5

Example 5 of the present invention is now described with reference to FIG. 8.

Figure 8:
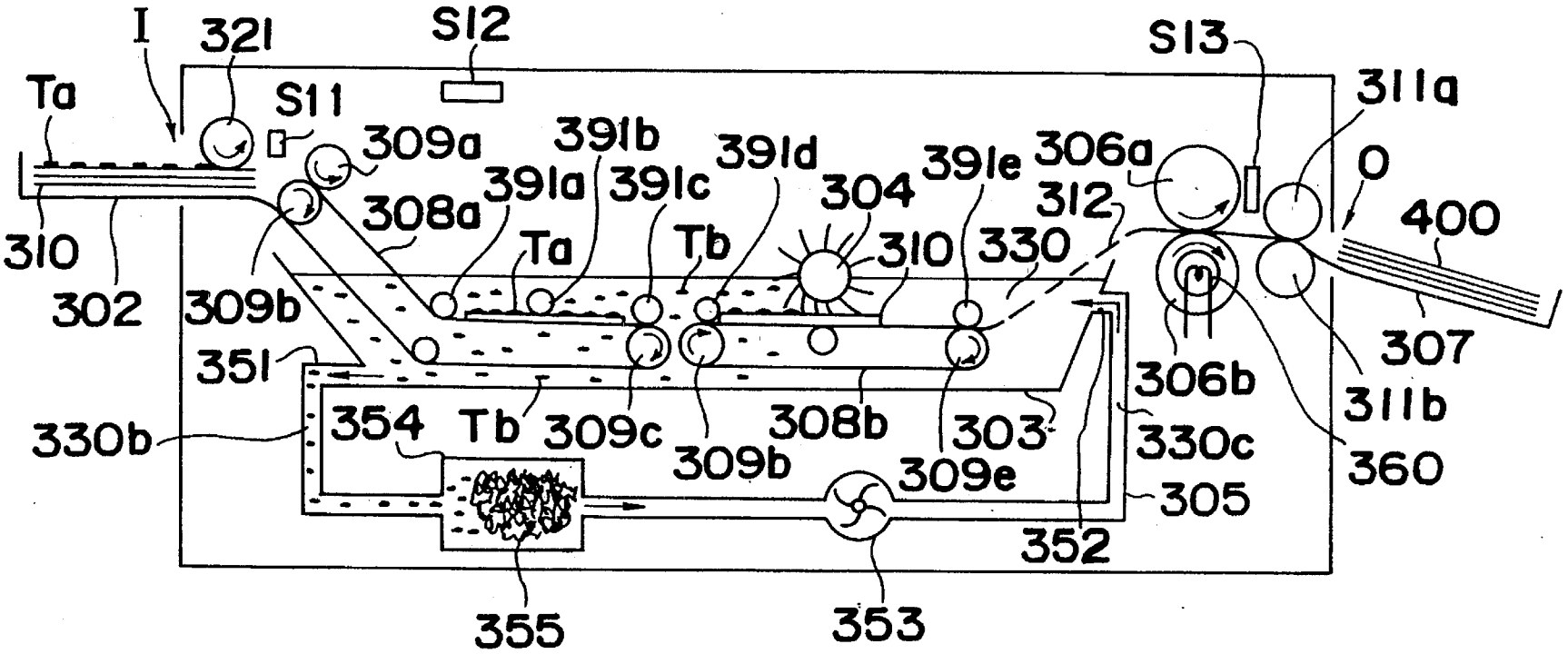
FIG. 8 is a view showing a schematic construction of an apparatus for regenerating a recording medium according to Example 5 of the present invention.

A regenerating apparatus 301 as shown in FIG. 8 is so arranged that it scrapes off prints on a recording medium in a cleaning liquid contained in an immersion bath. The regenerating apparatus 301 comprises: a paper feed means 302, 321 for feeding a recording medium into inside of the regenerating apparatus; an immersion bath 303 for containing a cleaning liquid 330 and immersing the recording medium therein for a specified time period to swell printed portions of the recording medium previously; a print removing means 304 for removing the printed portions by applying a physical treatment to the surface of the recording medium with the printed portions floated; a fluidizing means 305, 351–355 for fluidizing the cleaning liquid against a direction in which the recording medium is transported in the immersion bath; a drying means 360 for drying the recording medium with the cleaning liquid adhering thereto; a paper discharge means 307 for discharging the dried recording medium as regenerated paper; and transport means for transporting the recording medium.

In FIG. 8, a reference numeral 310 denotes a recording medium, indicating a sheet of paper or so-called OHP sheet of polyester film or others on which a toner image Ta containing at least a resin component is recorded. Such recording media are printed by conventionally known copying machines, printers, facsimiles, or other so-called OA equipment.

The paper feed means provided on the upper left portion of the apparatus in the figure comprises an opening I through which a recording medium 310 is introduced, and a paper feed tray 302 installed so as to transport the recording medium 310 to the opening I. The recording medium 310 may be fed to the paper feed tray 302 either manually by the operator, or continuously by using an ADF (Automatic Document Feeder) which can automatically feed documents in copying machines and the like.

The recording medium 310 that has been pulled out from the paper feed tray 302 by a paper feed roller 321 is pinched at its end portion between a feed roller pair 309*a*, 309*b*, being stopped. A sensor S11 in the figure is so set as to issue a start signal at a time point when one end portion of the recording medium 310 placed on the paper feed tray 302 is entered into inside of the apparatus 301 through the opening I so that feed rollers 309*a*–309*e* are driven to rotate by an unshown drive means (e.g. a motor) according to the signal. Otherwise, it may also be controlled that the start signal is issued only when an input by the operator is sensed by a separately provided switch S12.

The feed roller 309*a* is urged into contact at a constant pressure with the feed roller 309*b* with a later-described transport belt 308*a* pinched therebetween. In the present invention, it is preferable that at least one of the feed roller pair 309*a* and 309*b* is made of an elastic material, as exemplified by a surface-roughed urethane roller.

A transport belt 308*a* is stretched between the feed rollers 309*b*, 309*c* while a transport belt 308*b* is stretched between the feed rollers 309*d*, 309*e*. The transport belts 308*a*, 308*b* are driven to rotate at a specified speed in the arrow direction in the figure with rotating feed rollers 391*b*–391*e*. Holding rollers 391*a*, 391*b*, and 391*c* are in press contact on the transport belt 308*a* while holding rollers 391*d*, 391*e* are in press contact on the transport belt 308*b*. The recording medium has its print removed by the print removing means 304 while it is transported between the transport belt and the holding rollers at a specified speed as it is immersed in the cleaning liquid 330 contained in the immersion bath 303. Thereafter, the recording medium is transported through the drying means to a calender roll pair 311*a*, 311*b*.

The feed roller pair 309*a*, 309*b* and the feed rollers 309*c*–309*e* within the immersion bath are controlled by a sensor S13 to be driven to rotate, and so arranged as to being driven continuously until the recording medium 310 securely reaches the calender roll pair 311*a*, 311*b*. Otherwise, without the sensor S13, a timer may be arranged to control a predetermined time period for the rollers to be driven to rotate.

The recording medium 310 that has been transported into the immersion bath 303 with the moving transport belt 308*a* is temporarily stopped there to be immersed in the cleaning liquid 330 for a specified time period. The toner Ta fixed on the recording medium is swollen by action of the cleaning liquid.

In this example, Tosclean D (made by Nagamune Sangyo K.K.), later described, is used as the cleaning liquid. The immersion time is fixed at 30 sec. for its use under optimized conditions. After an elapse of 30 sec., the feed rollers are driven so that the recording medium is transported to the process of print removal treatment.

Figure 11:
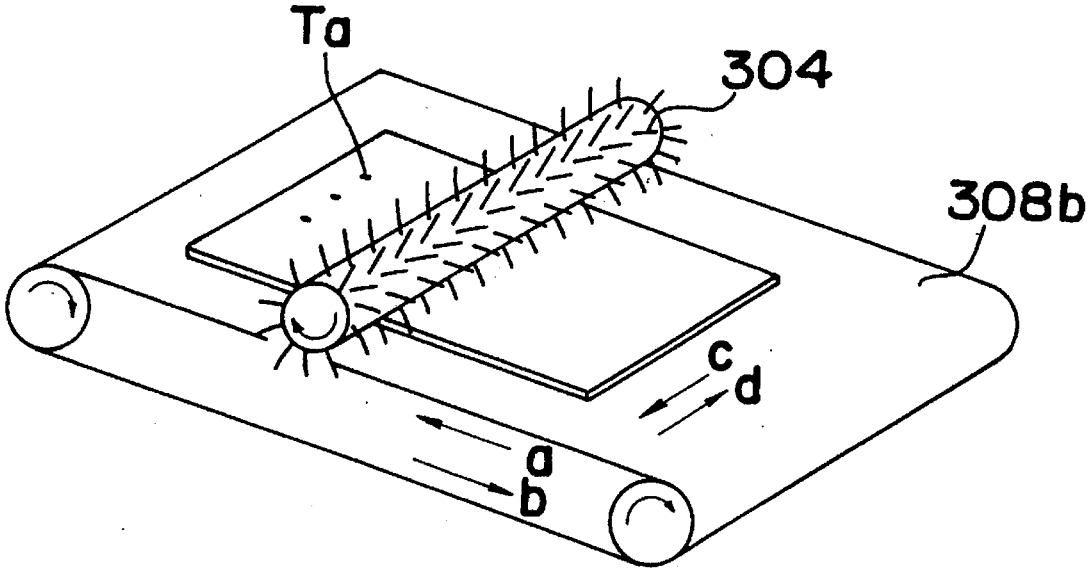
FIG. 11 is a view showing an example of a print removing means of an apparatus for regenerating a recording medium of the present invention.

Subsequently, a physical force is applied to the surface of the recording medium by the print removing means 304, thereby scraping off printed portions. In this example, a rotary brush is provided as the print removing means. As shown in FIG. 11, while bristles of the rotary brush are rotated in sliding contact with the recording medium surface, the rotary brush is reciprocated along a direction in which the recording medium is transported (direction indicated by arrow a and b) or along its perpendicular direction (direction indicated by arrow c and d). As a result, the printed portions can be efficiently scraped off without damaging the surface of the recording medium 310.

The material of the bristles of the rotary brush is preferably polymer fibers such as nylon, acryl, or polyester, or fibers of wool or the like.

The form of the print removing means 304 is not limited to the above-mentioned rotary brush. For example, it may be a cloth belt (web) stretched between the drive rollers. Print removing effect can be further enhanced by using fiber-woven cloth or by an arrangement that a blade is put into press contact with the web surface to scrape swollen toner or other dirties adhering to the web into a collection recovery box. Also, the print removing means may be a blade made of an elastic material such as metal or rubber. These are combined with an urging means (e.g. a spring) to scrape off the toner from on the surface of the recording medium 310. Further, the print removing means is not limited to the solid-state friction method as shown above, but may also be of a method that the cleaning liquid is intensely blown against the recording medium through slitted nozzles as a jet stream to thereby separate the toner off. These means may also be used in combination.

In this example, the recording medium is temporarily stopped within the immersion bath so as to be immersed in the cleaning liquid to a sufficient extent, and then subjected to a print removing treatment by the print removing means. Otherwise, the recording medium may be subjected to a print removing treatment while it is transported within the immersion bath at a specified speed without being stopped. The speed at which the recording medium is moved within the immersion bath is determined as required from the balance between the print removing efficiency and the regeneration speed of the recording medium.

Toner Tb separated off from the recording medium surface through the print removing treatment is suspended to float in the cleaning liquid or settled as large plastic powder particles. If these are left as they are in the cleaning liquid, they would readhere to the recording medium and be readsorbed, resulting in image noise such as black spots. Therefore, it is necessary to provide a fluidizing means for circulating the cleaning liquid at the bottom of the immersion bath 303 to maintain the cleaning liquid in the immersion bath normally clean.

A reference numeral 305 in the figure denotes a circulation path for circulating the cleaning liquid, being provided with a pump 353 for taking in the cleaning liquid 330 through an inlet 351 and discharging it through an outlet 352. A filter 354 is provided above the pump 353 with respect to the circulation direction of the cleaning liquid. The filter serves to collect the toner Tb and other impurities floating in the immersion bath 303, so that the cleaning liquid in the immersion bath 303 is normally kept at a constant level of cleanness. A filter substance 355 is provided so as to be replaceable. Available as the material of the filter substance are glass wool, activated carbon, cloth of natural fibers, and the like.

Furthermore, if the direction in which the cleaning liquid is circulated is opposed to the direction in which the recording medium is transported, the recording medium is normally fed with a clean cleaning liquid 330*c*. As a result, the toner and others that have once been separated from the recording medium, floating or settling in the cleaning liquid, can be prevented from readhering to or being readsorbed to the recording medium. This allows a regenerated recording medium with high degree of whiteness to be obtained. Moreover, the cleaning liquid can be used repeatedly until its function deteriorates, which is very economical.

As the transport belts 308*a*, 308*b* for transporting the recording medium in the immersion bath, use can be preferably made of thin films, elastic materials, unwoven cloths, fiber-woven cloths, or plate-shaped ones made of metal, polymers, steel, and the like. Materials for the belts which are anticorrosive to the cleaning liquid should be selected. Further, if the transport belt surface is roughened or meshed, its ability of transporting the recording medium 310 can be improved.

If the distance between the holding rollers 391*a* and 391*b*, the distance between the holding rollers 391*b* and 391*c*, the distance between the holding roller 391*d* and the print removing means 304, or the distance between the print removing means 304 and the holding roller 391*e* is longer than the length of the recording medium 310, the recording medium 310 would float up within the immersion bath 303, resulting in insufficient removal of prints. Therefore, each distance is desirably set shorter than the length of the recording medium 310 in its transport direction. As a result, in the case of a regenerating apparatus in which paper size and feed form of the recording medium can be selected among B5 size longitudinal feed, A4 size longitudinal feed, B4 size longitudinal feed, and A3 size longitudinal feed, the distances between the holding rollers are made shorter than the longitudinal length of B5 size paper. However, if the recording medium 310 is swollen by the cleaning liquid 330 such that it is put into close contact with the transport belts 308*a*, 308*b*, the distances between the holding rollers do not need to be set as described above for prevention of the recording medium's floating up.

Within the immersion bath 303 there may be provided an ultrasonic vibration means or a heater for facilitating print removal. Since the cleaning liquid often varies in the print removing effect depending on its temperature, a heater, if used to properly adjust the temperature of the cleaning liquid, helps enhance the print removing effect. The optimum temperature, difficult to specify as it is due to its difference among the types of the cleaning liquid 330, is preferably maintained at about 30°–50° C., in general.

The recording medium that has been completed with the print removing treatment as described above is transported to the drying means through a transport guide plate 312, and dried there. The drying means 306 comprises a rubber roller pair 306*a*, 306*b* urged into contact with each other, and a heater 360 for heating the roller 306*b* from the inside.

The drying means is not necessarily required to be in the form of heating by heat transfer, but may be in the form of spraying hot air or utilizing radiant heat of a xenon lamp or the like. The heating temperature, differing depending on the type of the cleaning liquid 303 and the recording medium 310 used, is desirably set at generally 40°–90° C., preferably 50°–60° C. Lower heating temperatures would result in too longer a drying time, being unsuitable for practical use. Higher heating temperatures would cause damage to the recording medium such as deformation of OHP sheets or yellowish change of paper.

The recording medium 310 that has passed the drying means is transported to the calender roll pair 311*a*, 311*b*. The calender roll pair is a pair of metallic rolls urged into contact with each other. Making the recording medium 310 pass between the rolls allows the recording medium to be recovered to some extent out of minute damage on its surface, such as minute defects caused by a stapler or the like, traces of bending, and the like given through the print treatment. Further, in the case of paper, the recording medium can be given gloss through this process.

It is noted that the calender roll pair may include a heater to also serve drying function. Such an arrangement eliminates the need of providing the drying means, allowing the process to be simplified.

The recording medium 310 that has passed between the calender roll pair 311*a*, 311*b* is discharged through a discharge outlet O onto the paper discharge means 307 as regenerated paper 400. Thus, the operation of a sequence of regenerating processes is completed.

As described in detail above, this example is so arranged that the recording medium is previously immersed in the cleaning liquid contained in the immersion bath, making the toner enough swollen, and thereafter the toner is removed by the print removing means. As a result, the physical force applied to the recording medium surface by the print removing means 304 can be minimized so that the print treatment can be carried out without damaging the recording medium 310. Also, as the print removing treatment is carried out in the flow of the cleaning liquid, the recording medium surface is normally fed with fresh cleaning liquid so that regenerated paper with such high degree of whiteness as to serve enough for reuse can be offered. Furthermore, in the regenerating apparatus of the present invention, the appropriate selection of the cleaning liquid makes it possible to remove not only output prints but also inks written on the recording medium with ball point pens, fluorescent pens, felt pens, vermilion inkpads, and pencils.

EXAMPLE 6

Figure 9:
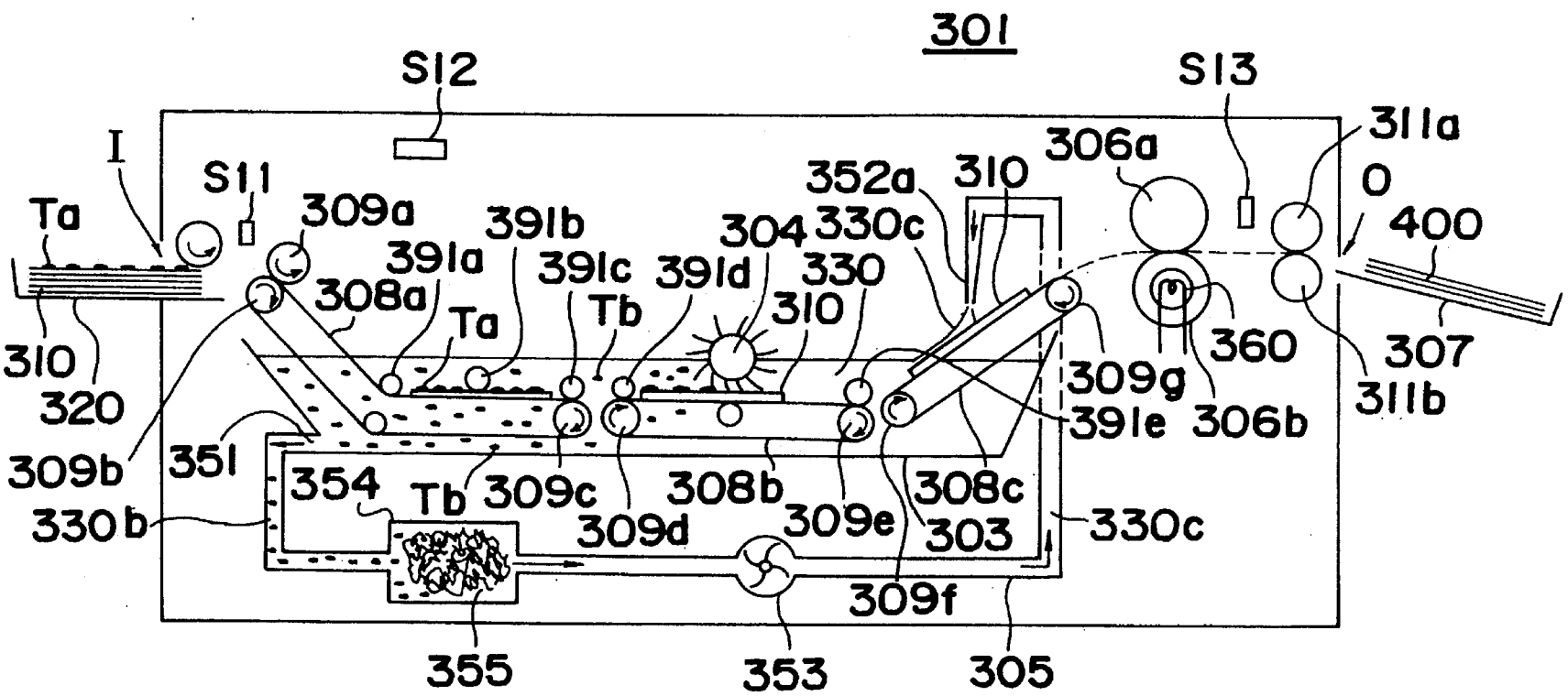
FIG. 9 is a view showing a schematic construction of an apparatus for regenerating a recording medium according to Example 6 of the present invention.

FIG. 9 shows a schematic construction of a regenerating apparatus of this example.

FIG. 9 represents a regenerating apparatus in which a recording medium 310 fed by a paper feed means is immersed into a cleaning liquid 330 contained in an immersion bath 303, where it is subjected to print removing treatment by a print removing means 304, and thereafter the recording medium is rinsed on its surface by a clean cleaning liquid through a nozzle 352*a* while it is transported to the drying process after being pulled obliquely upward from within the cleaning liquid by a transport belt 308*c*. It is noted that the transport belt 308*c* moves with feed rollers 309*f*, 309*g* being driven to rotate.

The clean cleaning liquid discharged from the nozzle 352*a* flows into the immersion bath 303 and then forms a flow in a direction opposite to the direction in which the recording medium 310 moves, thus being circulated from an inlet 351 to a filter 354. This action of the cleaning liquid causes a dirty cleaning liquid 330*b* containing floating toner particles Tb to fast flow toward a direction opposite to the direction in which the recording medium moves. Meanwhile, the recording medium that has undergone the cleaning process is moved to the nozzle 352*a*, which is an flow outlet of the clean cleaning liquid 330*c*, so that the recording member will almost never be brought into contact with the floating toner particles Tb. As a result, these toner particles are prevented completely from readhering onto the recording medium.

Even if the floating toner particles Tb have readhered to the recording medium in the immersion bath, the recording medium 310 is intensely rinsed by the clean cleaning liquid while being pulled obliquely upward, so that the readhering toner is washed away substantially. As a result, the recording medium 310 is prevented from being sent to the subsequent drying process with those toner particles Tb placed thereon.

EXAMPLE 7

Figure 10:
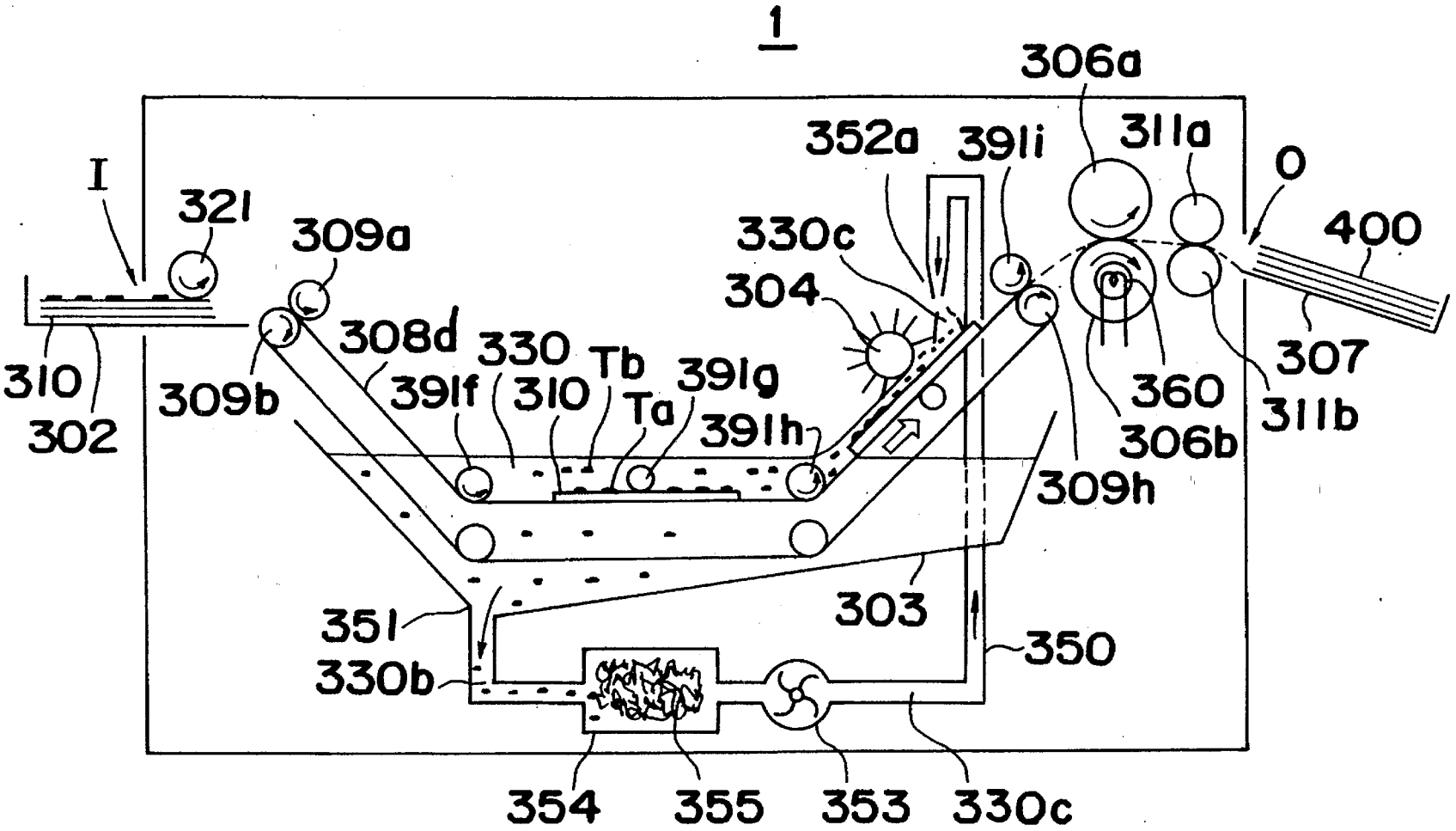
FIG. 10 is a view showing a schematic construction of an apparatus for regenerating a recording medium according to Example 7 of the present invention.

FIG. 10 shows a schematic construction of a regenerating apparatus of this example.

The regenerating apparatus of this example is the one in which a recording medium 310 fed by a paper feed means is immersed in a cleaning liquid 330 contained in an immersion bath 303 and thereafter temporarily pulled out of the cleaning liquid to be subjected to print removing treatment.

A reference numeral 308*d* in this figure denotes a transport belt for transporting the recording medium. The transport belt moves with feed rollers 309*b*, 309*h* being driven to rotate by an unshown drive means. The recording medium is transported at a specified speed between the transport belt and holding rollers 391*f*, 391*g*, and 391*h* in the cleaning liquid contained in the immersion bath. After toner Ta is enough swollen in the immersion bath 303, the recording medium is pulled out of the immersion bath 303 obliquely upward by the transport belt 308*d*. Then the toner on the recording medium is separated out by the print removing means 304. The cleaning liquid is discharged downward from the nozzle 352*a* toward the recording medium surface. Flow rate of the cleaning liquid is adjusted to such an extent that the recording medium surface is washed over. The toner separated out from the recording medium by the print removing means is washed away by the cleaning liquid discharged from the nozzle 352*a*, flowing into the immersion bath to float up or settle down. These impurities are collected by a separately provided filter 354. The cleaned-up cleaning liquid is again discharged from the nozzle 352*a*.

With the above arrangement, even if floating toner particles Tb are brought into contact with the recording medium to readhere thereto after completion of the print removing treatment, the recording medium 310 is rinsed by a clean cleaning liquid while being pulled obliquely upward. As a result, the readhering toner is washed away sufficiently. Accordingly, the recording medium 310 is prevented from going to the subsequent drying process with toner particles placed thereon. Thus, generation of image noise such as black spots can be suppressed.

EXAMPLE 8

Figure 12:
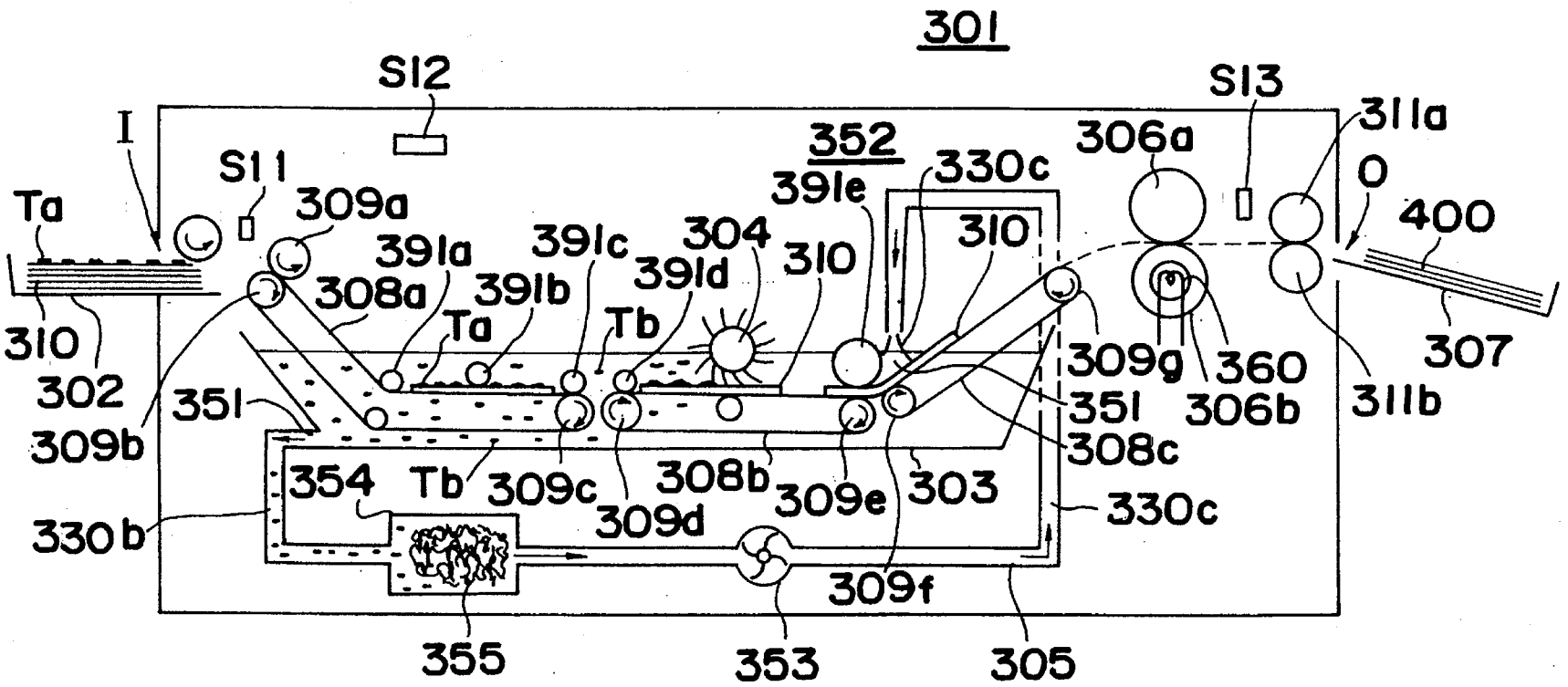
FIG. 12 is a view showing a schematic construction of an apparatus for regenerating a recording medium according to Example 8 of the present invention.

FIG. 12 shows a schematic construction of a regenerating apparatus of this example.

The regenerating apparatus of this example is of the same construction as the regenerating apparatus of Example 5 (FIG. 8), except for a fluidizing means for cleaning liquid. Description of the portions other than the fluidizing means is omitted.

An outlet nozzle 352 in FIG. 12 is fixed at such a position that it discharges a clean cleaning liquid to around the center of the recording medium that has come to a position where it is pulled obliquely upward out of the cleaning liquid by the transport belt 308*c*. The recording medium surface is washed over by a clean cleaning liquid discharged in an intense flow from the nozzle. Meanwhile, a holding roller 391*e* is located above the blowoff of the outlet nozzle 352 in the direction in which the recording medium is transported. Further, the holding roller 391*e* is so arranged as to be partially projected out of the cleaning liquid level, thereby forming a liquid sump 331.

Figure 13:
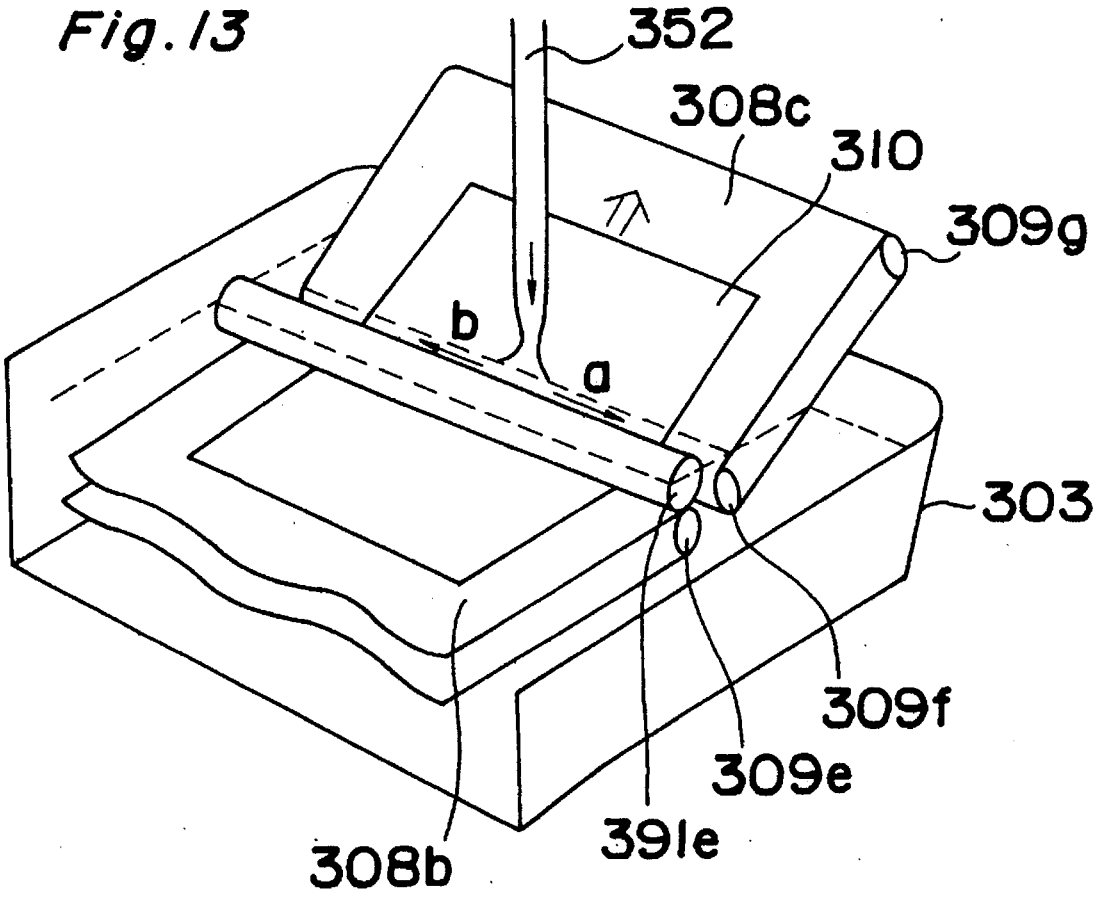
FIG. 13 is an enlarged view of the rinsing system of the apparatus for regenerating a recording medium according to Example 8 of the present invention.

FIG. 13 is an enlarged view of the rinsing system of an apparatus for regenerating a recording medium of FIG. 12.

The cleaning liquid discharged to around the center of the recording medium flows into the liquid sump, colliding with the roller 391*e*. Then the cleaning liquid flows in a direction perpendicular to the direction in which the recording medium 310 moves, as indicated by arrow a and b in the figure. The cleaning liquid flows generally evenly leftward and rightward along the surface of the recording medium. Impurities such as toner particles that are floating and being suspended in the cleaning liquid after being separated out from the recording medium surface by the print removing means move to both side ends of the recording medium along with the flow of the cleaning liquid, flowing downstream in the direction in which the recording medium is transported. Then the cleaning liquid containing the impurities is taken into the transport path through the inlet and, after passing through the filter 354, cleaned and again discharged from the outlet nozzle. This action of the cleaning liquid prevents a dirty cleaning liquid 330*b* containing the floating toner particles Tb from flowing at the print removing means in the direction in which the recording medium moves. Meanwhile, after the cleaning process, the recording medium moves to the nozzle 352, which is an outlet of the clean cleaning liquid 330*c*, so that the recording member will almost never be brought into contact with the floating toner particles Tb. Further, even if toner particles readhere to the recording medium surface, the recording medium surface is washed over by rinsing from the outlet nozzle 352, so that the cleaning liquid containing the impurities moves to both side ends of the recording medium, fast flowing downstream in the direction in which the recording medium is transported. As a result, the recording medium is prevented from being subjected to the subsequent drying process with toner particles placed thereon. Also, it is very economical that the cleaning liquid can be used repeatedly until its function deteriorates.

Furthermore, in this example, the holding roller 391*e* serves to interrupt the cleaning liquid, in which the toner removed by the print removing means is floating, from flowing into the rinsing area. As a result, the toner and other impurities that are floating or settled in the cleaning liquid can be prevented from readhering to or being readsorbed to the recording medium. Thus, a regenerated recording medium with even higher degree of whiteness can be obtained.

In this example, part of the holding roller 391*e* is projected out of the liquid level as stated before so as to fluidize the cleaning liquid discharged from the outlet nozzle 352 in a direction perpendicular to the direction in which the recording medium is transported, but this is not limitative. For example, when a holding roller of small diameter is used, there may be additionally provided a plate-like member for interrupt use.

EXAMPLE 9

Figure 14:
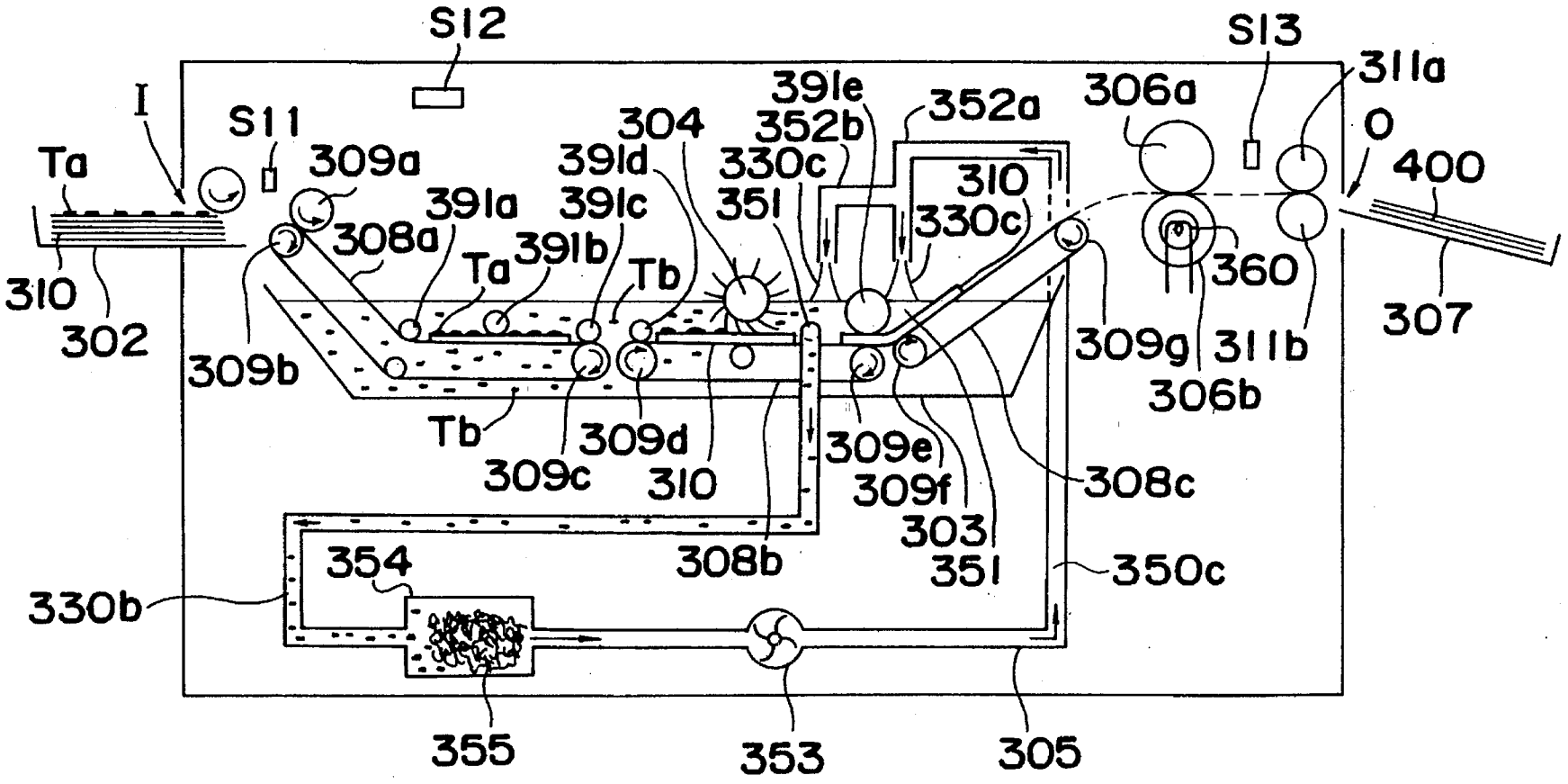
FIG. 14 is a view showing a schematic construction of an apparatus for regenerating a recording medium according to Example 9 of the present invention.
Figure 15:
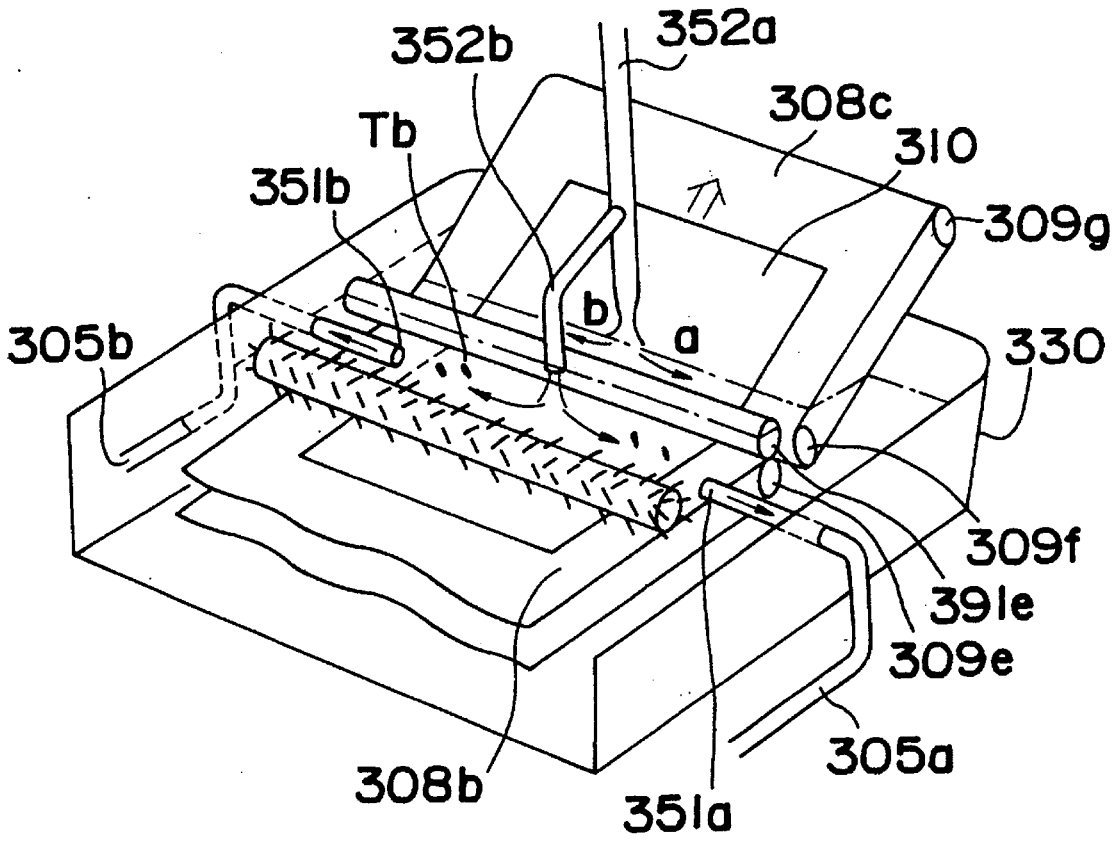
FIG. 15 is an enlarged view of the rinsing system of the apparatus for regenerating a recording medium according to Example 9 of the present invention.

FIG. 14 shows a schematic construction of a regenerating apparatus of this example. FIG. 15 is an enlarged view of the rinsing area of the regenerating apparatus of FIG. 14.

In FIG. 14, in proximity to both ends of the print removing means within the immersion bath there are provided inlets 351*a* and 351*b* (FIG. 15) for taking in a cleaning liquid. Further, a pump 353 is provided so that the cleaning liquid taken in from the inlets is discharged from the outlet nozzle after its impurities are collected by a filter 354 provided in the transport path. The outlet nozzle in this example is in such a form that the outlet nozzle in the regenerating apparatus of FIG. 12 is branched into two, 352*a* and 352*b*. The outlet nozzle 352*b* is provided also between the print removing means 304 and the holding roller 391*e* in addition to the rinsing area, so that a clean cleaning liquid is also discharged from the outlet nozzle 352*b*.

The cleaning liquid discharged from the outlet nozzle 352*a* in principle flows in a direction perpendicular to the direction in which the recording medium moves, as in the regenerating apparatus shown in FIG. 12, flowing generally evenly leftward and rightward along the recording medium surface. Also, the clean cleaning liquid 330*c* discharged from the outlet nozzle 352*b* serves to push the cleaning liquid dirtied by toner Tb separated out from the recording medium surface by the print removing means, toward the inlets 351*a*, 351*b*. Floating toner particles Tb are promptly taken in from the inlets. The cleaning liquid passes through the circulation path, and is cleaned and again discharged from the outlet nozzles 352*a*, 352*b*. Even if the floating toner particles Tb readhere to the recording medium in the immersion bath, the recording medium is intensely rinsed by the clean cleaning liquid from the nozzle 352*a* toward the surface of the recording medium 310, so that the readhering toner is washed away sufficiently. Thus, the recording medium 310 is prevented from being subjected to the subsequent drying process with the toner particles Tb placed thereon. Moreover, in this example, toner, paper powder, and the like separated out of the recording medium surface are suppressed from diffusing over the entire immersion bath to a minimum by the cleaning liquid being discharged from the outlet nozzle 352*b*. As a result, the cleaning liquid can totally be kept clean for a long time, while a regenerated recording medium with high degree of whiteness can be offered over a long time period.

EXAMPLE 10

Figure 16:
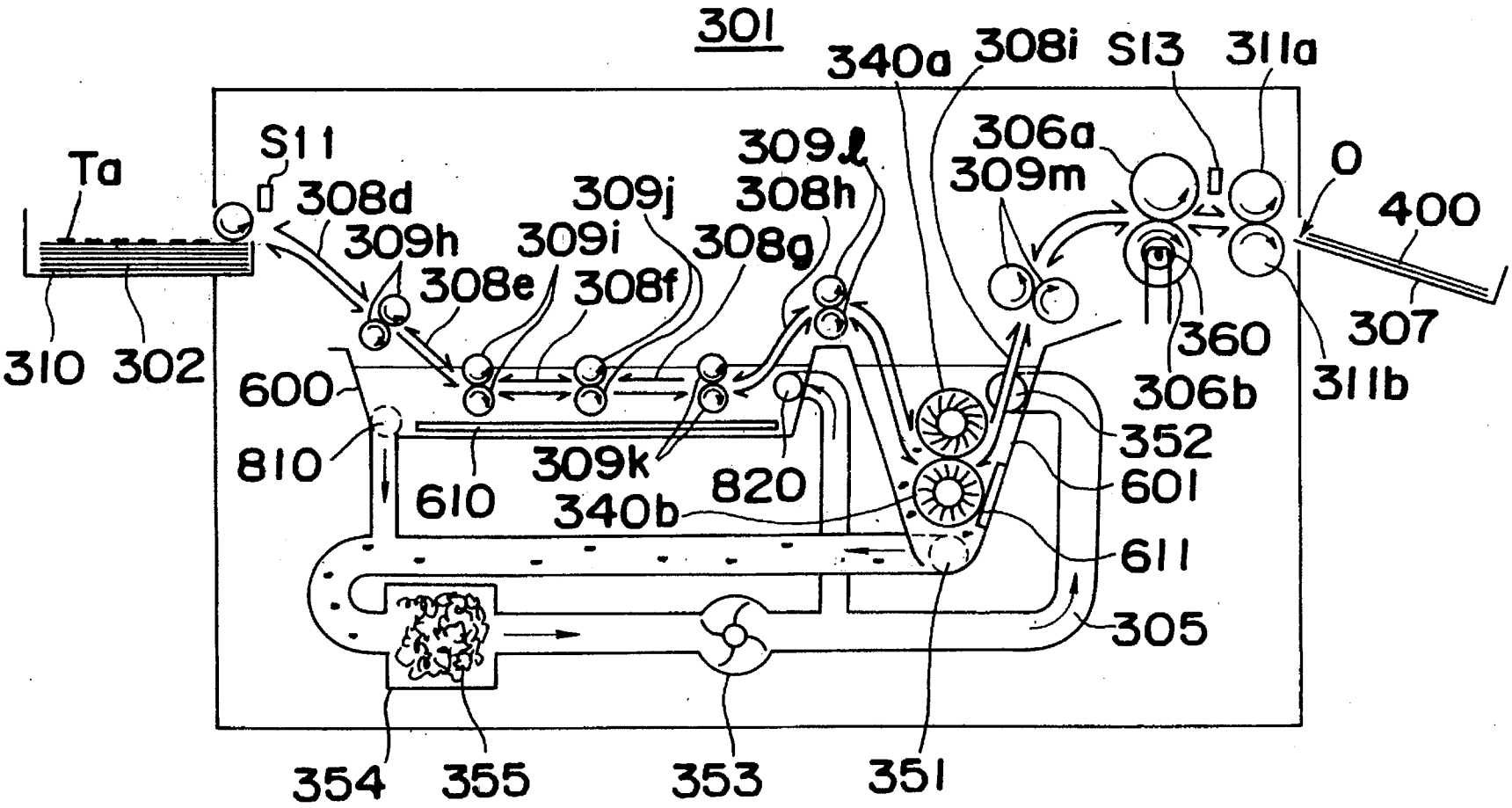
FIG. 16 is a view showing a schematic construction of an apparatus for regenerating a recording medium according to Example 10 of the present invention.

FIG. 16 shows a schematic construction of a regenerating apparatus of this example.

The regenerating apparatus of this example has two immersion baths in which a cleaning liquid is contained, i.e. a first immersion bath for immersing a recording medium for a specified time period to previously swell its printed portions, and a second immersion bath for applying a physical treatment to the recording medium surface by a print removing means to remove the printed portions.

A recording medium 310 fed by a paper feed tray 302 provided on an upper left portion of the regenerating apparatus is transported to a first immersion bath 600 by action of guides 308*d*, 308*e* and a feed roller pair 309*h*. Then the recording medium is transported in the cleaning liquid by guides 308*f*, 308*g* and feed roller pairs 309*i*, 309*j*, 309*k*. The printed portions of the recording medium are swollen by action of the cleaning liquid. It is noted that if the printed portions will not be easily swollen by the cleaning liquid, or if the immersion time is to be shortened, it is effective to elevate the cleaning liquid temperature by providing a planar heating means 610 such as a silicon rubber heater on the bottom of the immersion bath 600.

The recording medium once pulled up from the cleaning liquid by a guide 308*h* and a roller 309*l* is sent to the second immersion bath 601. Within the second immersion bath, a pair of rotary brushes 340*a*, 340*b* are provided as the print removing means. The rotary brushes each rotate in the forward direction with respect to the direction in which the recording medium is transported. The recording medium passes between the brushes, thereby having printed portions on its both surfaces scraped off. In addition, the brush pair is not limited to one in number, but may be provided in two, three, or other multiple stages when required.

Further, an outlet 352 for spouting a clean cleaning liquid is provided in proximity to a recording medium transport guide 308*i* above the second immersion bath. On the other hand, an inlet 351 for the cleaning liquid is provided at the bottom of a wall surface of the immersion bath opposite to the outlet. A reference numeral 305 in the figure denotes a transport path for circulating the cleaning liquid. A pump 353 is provided on the way of the transport path so as to allow the cleaning liquid taken in from the inlet 351 to be discharged from the outlet 352. As a result, the cleaning liquid in the second immersion bath flows in a direction generally perpendicular to the direction in which the recording medium moves. By this arrangement that the cleaning liquid is made to flow in a direction perpendicular to the direction in which the recording medium moves, the toner separated out of the recording medium surface by the print removing means fast moves to the discharge outlet along with the flowing cleaning liquid. Within the transport path, a filter 355 is provided above the pump with respect to the direction in which the cleaning liquid circulates. The toner and other impurities taken in from the discharge outlet are collected by the filter, and then spouted again from the outlet 352. Thus, the cleaning liquid in the second immersion bath is normally kept clean at a constant level of cleanness. Accordingly, also in the regenerating apparatus as shown in this example, the recording medium 310 is prevented from being subjected to the subsequent drying process with floating toner particles in the cleaning liquid placed thereon. As a result, generation of image noise such as black spots can be suppressed.

When a magnetic material such as magnetic-powder toner is used as the printing material, it is preferable to provide a magnetism generating means 611 such as a magnetic sheet in proximity to a print processing means 340*a*, 340*b* in the second immersion bath 601. Floating toner Tb including magnetic powder in the cleaning liquid is attracted and adsorbed by the magnetism generating means 611 provided in proximity to the print removing means, so that the floating toner Tb will be easily separated and removed from in the cleaning liquid. The magnetic sheet may be reused by perpendicularly pulling it up and wiping off the adsorbed toner or replacing with another.

Further, if the printing material (toner) contains a dye such as nigrosine, the dye may dissolve in the cleaning liquid, causing the liquid to be colored into an ink-like state. The dissolving dye would penetrate into the fibers of the recording medium having its printed portions removed. Regenerated paper with high degree of whiteness could no longer be obtained. Accordingly, the method of removing coloring components may be, for example, to provide a second filter filled with particles or pellets having sufficient adsorbing activities, such as activated carbon or molecular sieve, above to the filter 355 in FIG. 16 to adsorb and remove the dye components that have dissolved in the cleaning liquid.

In addition, in this example, an outlet 820 and an inlet 810 for the cleaning liquid are provided also to the inner wall of the first immersion bath 600. Toner that has separated from the recording medium surface in the first immersion bath is collected through the inlet and then trapped by the filter. The cleaning liquid thereby cleaned is again returned into the first immersion bath through the outlet 820.

Figure 17:
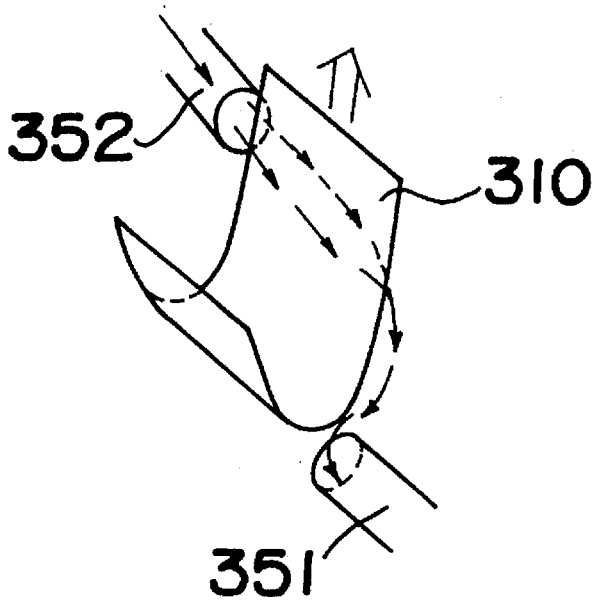
FIG. 17 is a conceptual view showing a fluidized state of the cleaning liquid in the apparatus for regenerating a recording medium according to Example 10 of the present invention.

FIG. 17 is a conceptual view showing a flowing state of the cleaning liquid in the second immersion bath.

As described above, the cleaning liquid spouted from the outlet flows in a direction generally perpendicular to the direction in which the recording medium moves. In this case, it is also possible that, by setting the positions of the outlet and the inlet, the cleaning liquid that has spouted from the outlet is branched into one flow along the front surface of the recording medium and the other flow along its rear surface, so that both surfaces of the recording medium can be simultaneously rinsed.

The recording medium that has had printed portions removed in the immersion bath is pulled up from the cleaning liquid and then, while passing a squeeze roller 309*m*, has its excess cleaning liquid squeezed. The resulting liquid is collected again into the immersion bath 601, so that consumption of the cleaning liquid is suppressed to a minimum very economically. Thereafter, the recording medium is dried by a drying means 306*a*, 306*b* and then, after passing the calender roll pair 311*a*, 311*b*, discharged onto the paper discharge tray 307. Thus, the operation of a sequence of regenerating processes is completed.

The cleaning liquid contained in the first immersion bath 600 in FIG. 16 flows in a direction opposite to the direction in which the recording medium is transported. However, the cleaning liquid may also be arranged to flow also in the first immersion bath in a direction generally perpendicular to the direction in which the recording medium is transported, as in the second immersion bath 601. For example, it is possible that several number of inlets are provided to a wall surface of the first immersion bath along the direction in which the recording medium is transported while several number of outlets are provided to another wall surface opposite to the foregoing wall surface, thereby making the cleaning liquid in the first immersion bath flow in a direction generally perpendicular to the direction in which the recording medium is transported. Furthermore, as applicable also to the other Examples of the present invention, the cleaning liquid may also be arranged to flow in a direction generally perpendicular to the direction in which the recording medium is transported, also around the position where the recording medium is immersed in the cleaning liquid to thereby make toner swollen.

The above-described cleaning liquid used in the regenerating apparatus of the present invention is described below.

The cleaning liquid to be used should be selected from those having such characteristics that they do not allow dye components such as a charge controller in the toner or coloring agents such as pigments and dyes to dissolve, but swell resin components constituting the toner so as to make the toner plastic and thereby make a toner image floated from inside to the surface of the recording medium. For example, an aqueous detergent, Tosclean D available in the market may be used as the cleaning solution in the present invention. The details of Tosclean D is disclosed U.S. application. Tosclean D is a pale yellow transparent liquid and has a acid value of about 2.1 mgKOH/g, a specific gravity of 1,020 (20° C.), pH of 7±0.5 (15° C.). Tosclean D contains no fluorine compound and no chlorine compound, which is indicated to destroy a ozone layer. Therefore, the cleaning solution does not influence adversely on environments of the earth. Further, because the cleaning solution displays low toxicity to a human body and incombustibility (no flash point), it is very suitable to apply the cleaning solution to a reproduction machine used in offices.

Conditions for immersion of the recording medium into the cleaning liquid may be set as required by taking into account the type of the recording medium, printing material (toner), cleaning liquid, apparatus for regenerating a recording medium and the like. In any case, the toner Ta on the recording medium should be easily removed from the recording medium by the print removing means. Immersion time, although varying depending on the type of the recording medium, printing material, cleaning liquid, apparatus for regenerating agent and the like, is preferably ten-odd seconds to a few minutes, in general.

What is claimed is:

1. A regenerating apparatus which regenerates a recording medium on a surface of which a toner image is formed by an electrophotographic apparatus, said regenerating apparatus comprising:

a processing unit including an immersion bath for containing a cleaning liquid;

a feeding member which feeds the recording medium into the immersion bath;

a removing member provided around the immersion bath and which physically removes the toner image on the recording medium immersed in the cleaning liquid within the immersion bath; and a drying member provided at a downstream side from the immersion bath with respect to a feeding direction of the recording medium and which dries the recording medium by heating, wherein said processing unit further includes a collecting system for collecting the toner removed by said removing member, said collecting system having a circulation path connecting an inlet and an outlet provided at the bottom of the immersion bath and through which the cleaning liquid in the immersion bath is circulated, a pump provided in the circulation path, and a filter provided in the circulation path and at the upstream side from the pump with respect to a direction of the circulation of the cleaning liquid.

2. The apparatus for regenerating a recording medium of claim 1, wherein said removing member includes a rotatable brush in contact with the surface of the recording medium in the immersion bath, said brush being formed of polymer fibers so that the surface of the recording medium is kept free from damage.

3. An apparatus for regenerating a recording medium comprising:

a processing unit including an immersion bath for containing a cleaning liquid;

a feed means for feeding the recording medium into the immersion bath;

a print removing means for physically and completely removing prints from the recording medium immersed in the cleaning liquid within the immersion bath; and a drying means for drying the recording medium by heating after completion of removing of prints from the recording medium, the apparatus further comprising:

a guide means for guiding the recording medium into inside of the apparatus;

a discrimination means for discriminating whether the guided recording medium has prints on both surfaces thereof or on only one surface thereof, the guided recording medium being fed into the immersion bath by said feed means following the discrimination by the discrimination means;

a transport means for transporting the recording medium in a state that a recording medium that has had prints removed from one surface thereof is reversed, when the discrimination means has determined that the recording medium is printed on both surfaces thereof;

a second processing unit for feeding the cleaning liquid to the other surface of the recording medium transported by the transport means; and a second print removing means for removing prints from the other surface of the recording medium with the cleaning liquid.

4. The apparatus for regenerating a recording medium of claim 3, in which said cleaning liquid swells toner forming the prints on the recording medium so as to make the toner plastic and thereby make the toner float from inside to the surface of the recording medium; and the toner that has floated to the surface of the recording medium is scraped off the recording medium by the print removing means.

5. The apparatus for regenerating a recording medium of claim 4, in which the processing unit further includes:

a circulation means for circulating the cleaning liquid contained in the immersion bath; and a collection means for collecting the toner contained in the cleaning liquid circulating within the immersion bath.

6. The apparatus for regenerating a recording medium of claim 3, in which the print removing means includes a rotatable brush provided so as to be brought into contact with a surface of the recording medium in the immersion bath, said brush being formed of polymer fibers so that the surface of the recording medium is kept free from damage.

* * * * *